US010801757B2

(12) United States Patent
Hellmann

(10) Patent No.: US 10,801,757 B2
(45) Date of Patent: Oct. 13, 2020

(54) REFRIGERATION SYSTEM

(71) Applicants: Carrier Corporation, Farmington, CT (US); Sascha Hellmann, Mainz-Kostheim (DE)

(72) Inventor: Sascha Hellmann, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 571 days.

(21) Appl. No.: 15/324,321

(22) PCT Filed: Jul. 9, 2014

(86) PCT No.: PCT/EP2014/064706
§ 371 (c)(1),
(2) Date: Jan. 6, 2017

(87) PCT Pub. No.: WO2016/004988
PCT Pub. Date: Jan. 14, 2016

(65) Prior Publication Data

US 2017/0159977 A1 Jun. 8, 2017

(51) Int. Cl.
*F25B 1/10* (2006.01)
*F25B 5/02* (2006.01)
(Continued)

(52) U.S. Cl.
CPC ..... *F25B 1/10* (2013.01); *F25B 5/02* (2013.01); *F25B 9/08* (2013.01); *F25B 41/04* (2013.01);
(Continued)

(58) Field of Classification Search
CPC ..... F25B 1/10; F25B 9/08; F25B 5/02; F25B 41/04; F25B 2400/16; F25B 2400/13;
(Continued)

(56) References Cited

U.S. PATENT DOCUMENTS 4,324,105 A 4/1982 Cann
6,658,888 B2 12/2003 Manohar et al.
(Continued)

FOREIGN PATENT DOCUMENTS

CN 1265136 C 7/2006
CN 101097100 A 1/2008
(Continued)

OTHER PUBLICATIONS

Chinese First Office Action and Search Report for application CN 20140080513.6, dated Nov. 5, 2018, 8 pages.
(Continued)

*Primary Examiner* — Len Tran
*Assistant Examiner* — Melodee Jefferson
(74) *Attorney, Agent, or Firm* — Cantor Colburn LLP

(57) ABSTRACT

A refrigeration system (1) has A) an ejector circuit (3) comprising: Aa) a high pressure compressor unit (2) comprising at least one compressor (2*a*, 2*b*, 2*c*, 2*d*); Ab) a heat rejecting heat exchanger/gas cooler (4); Ac) an ejector (6); Ad) a receiver (8) having a gas outlet (8*b*) which is connected to an inlet of the high pressure compressor unit (2). B) a normal cooling temperature flowpath (5) comprising in the direction of flow of the refrigerant: Ba) a normal cooling temperature expansion device (10) fluidly connected to a liquid outlet (8*c*) of the receiver (8); Bb) a normal cooling temperature evaporator (12); Bc) an ejector secondary inlet line (68) with an ejector inlet valve (26) fluidly connecting an outlet (12*b*) of the normal cooling temperature evaporator (12) to a suction inlet (6*b*) of the ejector (6); and Bd) a normal cooling temperature flowpath valve unit (22) configured for fluidly connecting the inlet of the high pressure compressor unit (2) selectively either to the gas outlet (8*b*) of the receiver (8) or to the outlet (12*b*) of the normal cooling temperature evaporator (12); C) a freezing temperature
(Continued)

flowpath (7) comprising in the direction of flow of the refrigerant: Ca) a freezing temperature expansion device (14) fluidly connected to the liquid outlet (8*c*) of the receiver (8); Cb) a freezing temperature evaporator (16); Cc) a freezing temperature compressor unit (18) comprising at least one freezing temperature compressor (18*a*, 18*b*); and Cd) a freezing temperature flowpath valve unit (20) configured for fluidly connecting the outlet of the freezing temperature compressor unit (18) selectively either to the inlet of the high pressure compressor unit (2) or to the ejector inlet valve (26).

14 Claims, 4 Drawing Sheets

(51) Int. Cl.
*F25B 9/08* (2006.01)
*F25B 41/04* (2006.01)

(52) U.S. Cl.
CPC ... *F25B 2341/0012* (2013.01); *F25B 2400/13* (2013.01); *F25B 2400/16* (2013.01)

(58) Field of Classification Search
CPC .... F25B 2341/0012; F25B 1/06; F25B 9/008; F25B 2341/0014; F25B 20/05
See application file for complete search history.

(56) References Cited

U.S. PATENT DOCUMENTS

| | | | | |
|---|---|---|---|---|
| 6,675,609 | B2 | 1/2004 | Takeuchi et al. | |
| 6,834,514 | B2 | 12/2004 | Takeuchi et al. | |
| 7,325,414 | B2 | 2/2008 | Taras et al. | |
| 8,109,111 | B2 | 2/2012 | Yamada | |
| 8,375,741 | B2 | 2/2013 | Taras et al. | |
| 2010/0162751 | A1 | 7/2010 | Nishijima et al. | |
| 2011/0005268 | A1* | 1/2011 | Oshitani | F25B 41/00 62/500 |
| 2012/0167601 | A1* | 7/2012 | Cogswell | F25B 1/10 62/115 |
| 2012/0266618 | A1 | 10/2012 | Levy et al. | |

FOREIGN PATENT DOCUMENTS

| | | | | |
|---|---|---|---|---|
| CN | 101573579 | A | 11/2009 | |
| CN | 102272541 | A | 12/2011 | |
| CN | 103282730 | A | 9/2013 | |
| CN | 103429975 | A | 12/2013 | |
| CN | 103597296 | A | 2/2014 | |
| CN | 103842745 | A | 6/2014 | |
| DE | 102004007932 | A1 | 9/2004 | |
| DE | 102011100198 | A1 | 11/2011 | |
| EP | 2221559 | A1 | 8/2010 | |
| EP | 2450647 | A2 | 5/2012 | |
| EP | 2532991 | A2 | 12/2012 | |
| EP | 2594839 | A2 | 5/2013 | |
| JP | 2005249315 | A | 9/2005 | |
| WO | 2008076122 | A1 | 6/2008 | |
| WO | 2009091094 | A1 | 7/2009 | |
| WO | 2009091096 | A1 | 7/2009 | |
| WO | 2012092686 | A1 | 7/2012 | |
| WO | WO-2012092686 | A1 * | 7/2012 | F25B 1/10 |
| WO | 2012169146 | A1 | 12/2012 | |

OTHER PUBLICATIONS

International Search Report and Written Opinion for application PCT/EP20141064706, dated Mar. 10, 2015, 10 pages.

Visser, Klaas, "The World's First Multifunction Two Stage Transcritical CO2 Refrigeration System At a Food Processing Plant in Melbourne, Australia", ATMOsphere Oct. 11-12, 2011, Sofitel Brussels, 39 pages.

* cited by examiner

REFRIGERATION SYSTEM

The invention is related to a refrigeration system, in particular to a refrigeration system comprising an ejector and two refrigeration circuits providing different evaporator temperatures.

PRIOR ART

A refrigeration system comprising an ejector is disclosed e.g. by WO 2012/092686 A1. Based on various measured parameters, including ambient air temperature, pressure drop at the expansion valve, etc., the refrigeration system is switched between a base line mode and an ejector mode in order to enhance the energy efficiency of the system in at least some range of ambient temperatures.

It would be beneficial to increase the energy efficiency of a refrigeration system comprising an ejector and two refrigeration circuits providing different evaporator temperatures over a wide range of ambient temperatures.

DISCLOSURE OF THE INVENTION

A refrigeration system according to exemplary embodiments of the invention comprises:

A) an ejector circuit comprising in the direction of flow of a circulating refrigerant:

Aa) a high pressure compressor unit comprising at least one compressor;

Ab) a heat rejecting heat exchanger/gas cooler;

Ac) an ejector having a primary inlet fluidly connected to the outlet(s) of the heat rejecting heat exchanger/gas cooler;

a secondary inlet; and an outlet, which is fluidly connected to

Ad) a receiver having a gas outlet which is connected to an inlet of the high pressure compressor unit.

B) a normal cooling temperature flowpath comprising in the direction of flow of the refrigerant:

Ba) a normal cooling temperature expansion device fluidly connected to a liquid outlet of the receiver;

Bb) a normal cooling temperature evaporator;

Bc) an ejector secondary inlet line with a valve fluidly connecting an outlet of the normal cooling temperature evaporator to the secondary inlet of in the ejector; and Bd) a normal cooling temperature flowpath valve unit configured for fluidly connecting the inlet of the high pressure compressor unit selectively either to the gas outlet of the receiver or to the outlet of the normal cooling temperature evaporator; C) a freezing temperature flowpath comprising in the direction of flow of the refrigerant:

Ca) a freezing temperature expansion device fluidly connected to the liquid outlet of the receiver;

Cb) a freezing temperature evaporator;

Cc) a freezing temperature compressor unit comprising at least one freezing temperature compressor; and Cd) a freezing temperature flowpath valve unit configured for fluidly connecting the outlet of the freezing temperature compressor unit selectively either to the inlet of the high pressure compressor unit or to the ejector inlet valve.

The skilled person will easily understand that refrigeration systems according to embodiments of the invention may also comprise a plurality of heat rejecting heat exchangers/gas coolers, ejectors, normal cooling temperature expansion devices, normal cooling temperature evaporators, freezing temperature expansion devices and freezing temperature evaporators, respectively connected in parallel.

A refrigeration system according to exemplary embodiments of the invention can be operated in at least four different modes of operation, allowing to adjust the operation of the system to different conditions, which in particular includes the ambient air temperature, for operating the refrigeration system with high efficiency under changing conditions.

A refrigeration system according to exemplary embodiments of the invention in particular can be operated in a first mode of operation, which is called "standard operation mode" and includes the steps of:

circulating a first flow of refrigerant from the high pressure compressor unit via the heat rejecting heat exchanger/gas cooler, the ejector, and the receiver to the inlet side of the high pressure compressor unit;

directing a second flow of refrigerant from the receiver via the normal cooling temperature expansion device and the normal cooling temperature evaporator to inlet side of the high pressure compressor unit; and directing a third flow of refrigerant from the receiver via the freezing temperature expansion device, the freezing temperature evaporator and the freezing temperature compressor unit to the inlet side of the high pressure compressor unit.

Said "standard operation mode" has shown to be efficient at relatively low ambient temperatures, in particular at ambient temperatures below 10-15° C.

A refrigeration system according to an embodiment of the invention further may be operated in a second mode of operation, which is called "economizer mode" and includes the step of directing refrigerant from the gas outlet of the receiver to the economizer compressor of the high pressure compressor unit.

Said "economizer mode" has shown to be efficient at medium ambient temperatures, in particular at ambient temperatures between 10-15° C. and 18-20° C.

A refrigeration system according to exemplary embodiments of the invention also may be operated in a third mode of operation, which is called "first ejector mode" and includes the steps of circulating a first flow of refrigerant from the high pressure compressor unit via the heat rejecting heat exchanger/gas cooler; the ejector and the receiver back to the inlet side of the high pressure compressor unit;

directing a second flow of refrigerant from the receiver via the normal cooling temperature expansion device, the normal cooling temperature evaporator and the ejector inlet valve to the secondary inlet of the ejector; and directing a third flow of refrigerant from the receiver via the freezing temperature expansion device, the freezing temperature evaporator and the freezing temperature compressor unit to the inlet side of the high pressure compressor unit.

Said "first ejector mode" has shown to be efficient at higher ambient temperatures, in particular at ambient temperatures between 18-20° C. and 30-35° C.

A refrigeration system according to exemplary embodiments of the invention further may be operated in a fourth mode of operation, which is called "second ejector mode" and includes the steps of circulating a first flow of refrigerant from the high pressure compressor unit via the heat rejecting heat exchanger/gas cooler;

directing a second flow of refrigerant from the receiver via the normal cooling temperature expansion device, the normal cooling temperature evaporator and the ejector inlet valve to the secondary inlet of the ejector; and directing a third flow of refrigerant from the receiver via the freezing temperature expansion device, the freezing temperature evaporator, the freezing temperature compressor unit and the ejector inlet valve to the secondary inlet of the ejector.

Thus "second ejector mode" has shown to be efficient at very high ambient temperatures, in particular ambient temperatures above 30-35° C.

By selecting the most appropriate mode of operation, a refrigeration system according to exemplary embodiments of the invention can be operated with high efficiency over a very wide range of ambient temperatures, in particular from ambient temperatures below 10° C. to ambient temperatures above 35° C. Thus, the refrigeration system can be operated efficiently over a wide range of ambient conditions.

In the following a refrigeration system according to exemplary embodiments of the invention will be described with reference to the enclosed figures.

SHORT DESCRIPTION OF THE FIGURES

DETAILED DESCRIPTION OF THE FIGURES

The embodiment of a refrigeration system 1 shown in the figures comprises an ejector circuit 3, a normal cooling temperature flowpath 5, and a freezing temperature flowpath 7 respectively circulating a refrigerant.

In the figures, the flow of the refrigerant in the ejector circuit 3 is indicated by dashed lines, the flow of refrigerant in the normal cooling temperature flowpath 5 is indicated by dotted lines, and the flow of refrigerant in the freezing temperature flowpath 7 is indicated by dash-dotted lines.

Figure 1:
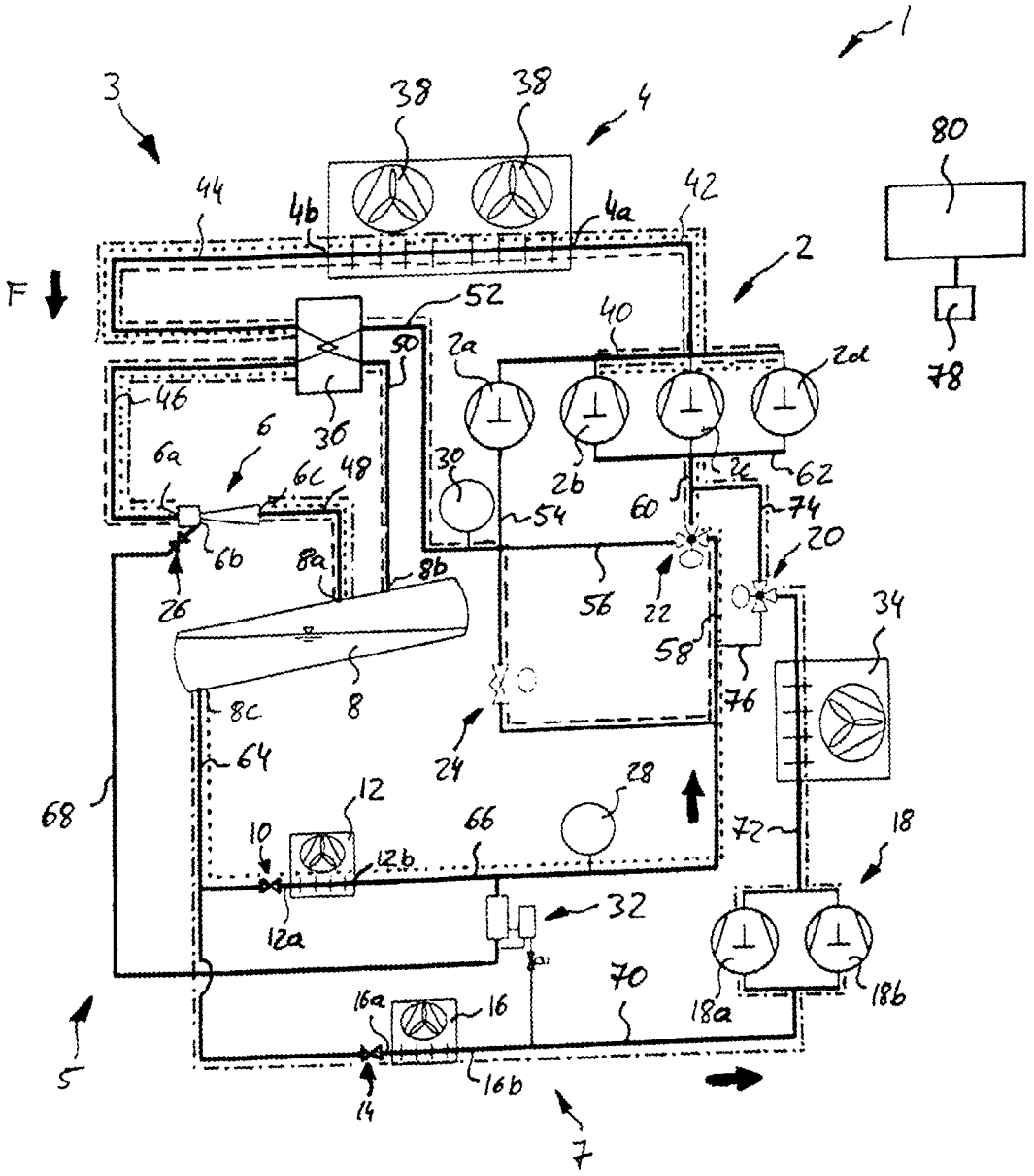
FIG. 1 shows a refrigeration system according to an exemplary embodiment of the invention operating in a first mode of operation.

FIG. 1 shows a refrigeration system 1 according to an exemplary embodiment of the invention operating in a first mode of operation.

The ejector circuit 3 comprises in the direction of the flow F of the circulating refrigerant a high pressure compressor unit 2 including a plurality of compressors 2*a*-2*d* connected in parallel. The compressors 2*a*-2*d* in particular include an economizer compressor 2*a* and a plurality of standard compressors 2*b*, 2*c* and 2*d*.

The high pressure side outlets of the compressors 2*a*-2*d* are fluidly connected to an outlet manifold 40, which collects the refrigerant from the compressors 2*a*-2*d* and delivers it via a heat rejection heat exchanger/gas cooler inlet line 42 to the inlet 4*a* of a heat rejecting heat exchanger/gas cooler 4. The heat rejecting heat exchanger/gas cooler 4 is configured for transferring heat from the refrigerant to the environment reducing the temperature of the refrigerant. In the embodiment shown in the figures, the heat rejecting heat exchanger/gas cooler 4 comprises two fans 38 which may be operated for blowing air through the heat rejecting heat exchanger/gas cooler 4 in order to enhance the transfer of heat from the refrigerant to the environment.

The cooled refrigerant leaving the heat rejecting heat exchanger/gas cooler 4 through its outlet 4*b* is delivered via a heat rejecting heat exchanger/gas cooler outlet line 44 and a successive ejector primary inlet line 46 to a primary inlet 6*a* of an ejector 6, which is configured for expanding the refrigerant to a reduced pressure. The expanded refrigerant leaves the ejector 6 via an ejector outlet 6*c* and is delivered by means of an ejector outlet line 48 to an inlet 8*a* of a receiver 8. Within the receiver 8, the refrigerant is separated by gravity into a liquid portion collecting at the bottom of the receiver 8 and a gas phase portion collecting in an upper portion of the receiver 8.

The gas phase portion of the refrigerant leaves the receiver 8 through a receiver gas outlet 8*b*, which is arranged in the upper portion of the receiver 8, and is delivered via a receiver gas outlet line 50, 52 to the inlet side of the high pressure compressor unit 2 completing the refrigerant cycle of the ejector circuit 3.

Optionally, a suction line heat exchanger 36 may be arranged in the receiver gas outlet line 50, 52 for allowing a transfer of heat between the refrigerant leaving the heat rejecting heat exchanger/gas cooler 4 and the gaseous refrigerant leaving the receiver 8 through the gas outlet 8*b*. Such a heat exchange has been found to enhance the efficiency of the refrigeration system 1.

In the first mode of operation ("standard operation mode"), which is illustrated by FIG. 1, gas phase refrigerant from the receiver 8 is delivered via an open economizer valve 24 and a second inlet line 58 downstream of the economizer valve 24 to a normal cooling temperature flowpath valve unit 22, which (in said first mode of operation) delivers the gas phase refrigerant via a high pressure compressor unit inlet line 60 and a high pressure compressor unit inlet manifold 62 to the inlets of the standard compressors 2*b*, 2*c*, 2*d*.

Refrigerant from the liquid phase portion of the refrigerant collecting at the bottom of the receiver 8 exits from the receiver 8 via its liquid outlet 8*c* and is delivered through a receiver liquid outlet line 64 to a first expansion device 10 ("normal cooling temperature expansion device") and a second expansion device 14 ("freezing temperature expansion device").

After having passed the normal cooling temperature expansion device 10, where it has been expanded further, the refrigerant enters through an inlet 12*a* into a first evaporator 12 ("normal cooling temperature evaporator"), which is configured for operating at "normal" cooling temperatures, in particular in a temperature range of 0° C. to 15° C. for providing "normal temperature" refrigeration.

In said first mode of operation ("standard operation mode"), the refrigerant, after having left the normal cooling temperature evaporator 12 via its outlet 12*b*, flows through a normal cooling temperature evaporator outlet line 66 into the second inlet line 58 of the normal cooling temperature flowpath valve unit 22 from where it is delivered to the inlet side of the high pressure compressor unit 2 together with the gas portion of the refrigerant supplied by the receiver 8.

An ejector secondary inlet line 68 branches from the normal cooling temperature evaporator outlet line 66 downstream of the normal cooling temperature evaporator 12 and fluidly connects the normal cooling temperature evaporator outlet line 66 to an inlet side of an ejector inlet valve 26. An outlet side of said ejector inlet valve 26 is fluidly connected to a secondary (suction) inlet 6*b* of the ejector 6. The ejector inlet valve 26, however, is closed in the standard operation mode, which is illustrated in FIG. 1, and in consequence no refrigerant is delivered from the outlet 12*b* of the normal cooling temperature evaporator 12 via the ejector secondary inlet line 68 into the ejector 6.

The portion of the liquid refrigerant, which has been expanded by the second (freezing temperature) expansion device 14 enters through an inlet 16*a* into a second ("freezing temperature") evaporator 16, which is configured for operating at freezing temperatures below 0° C., in particular at temperatures in the range of −15° C. to −5° C. for providing freezing temperature refrigeration. The refrigerant leaves the freezing temperature evaporator 16 through its outlet 16*b* and is delivered via a freezing temperature evaporator outlet line 70 to the inlet side of a freezing temperature compressor unit 18, which comprises one or more freezing temperature compressors 18*a*, 18*b*.

In operation, the freezing temperature compressor unit 18 compresses the refrigerant supplied by the freezing temperature evaporator outlet line 70 to medium pressure. After said compression, the refrigerant is delivered via a freezing temperature compressor unit outlet line 72 and an optional desuperheater 34 to a freezing temperature flowpath valve unit 20. Said freezing temperature flowpath valve unit 20 is configured for selectively directing the refrigerant supplied by the freezing temperature compressor unit 18 either via a first outlet line 74 into the high pressure compressor unit inlet line 60, which is done in the first mode of operation illustrated in FIG. 1, or via a second outlet line 76 into the second inlet line 58 of the normal cooling temperature flowpath valve unit 22 when the refrigeration system 1 is operated in an alternative mode of operation, which will be discussed further below.

In an embodiment, an oil separator 32 is provided within the ejector secondary inlet line 68. The oil separator 32 is configured for separating oil comprised in the refrigerant circulating within the normal cooling temperature flowpath 5 from said refrigerant and feeding said separated oil into the freezing temperature evaporator outlet line 70 in order to avoid that the oil collects within the normal cooling temperature flowpath 5 and in consequence the compressors 18*a*, 18*b*, 2*b*, 2*c*, 2*d* run out of oil. Said oil separation is in particular important when the refrigeration system 1 is operated in the third or fourth mode of operation, which will be discussed below, as in said modes of operation the refrigerant from the normal cooling temperature evaporator 12 is not fed back into the high pressure compressor unit 2. When the refrigeration system 1 is operated in one of said modes of operation, oil separation is necessary for transferring oil from the normal cooling temperature flowpath 5 back to the compressors 18*a*, 18*b*, 2*b*, 2*c*, 2*d*.

Pressure and/or temperature sensors 28, 30 are provided at the normal cooling temperature evaporator outlet line 66 and at the receiver gas outlet line 52, respectively, for measuring the pressure and/or the temperature of the refrigerant flowing in said lines 66, 52. Alternatively or additionally an ambient temperature sensor 78 is provided, which is configured for measuring the ambient temperature.

The sensors 28, 30, 78 deliver their outputs to a control unit 80, which is configured for controlling the operation of the compressor units 2, 18 and the valve units 20, 22 based on the outputs of at least some of the sensors 28, 30, 78 in order to operate the refrigeration system with optimal efficiency.

For transferring the data and the control signals, the control unit 80 may be connected with the sensors 28, 30, 78, the compressor units 2, 18 and the valve units 20, 22 by means of electrical and/or hydraulic control lines, which are not shown in the figures, or by means of a wireless connection.

The control unit 80 in particular is configured for switching the operation of the refrigeration system between different modes of operation by driving the valve units 20, 22 accordingly. Said switching in particular may be controlled and triggered based on the pressure and/or temperature data provided by the sensors 28, 30, 78.

The first mode of operation ("standard operation mode"), which has been described before with reference to FIG. 1, is typically employed at relatively low ambient temperatures, e.g. at ambient temperatures below 10-15° C.

Figure 2:
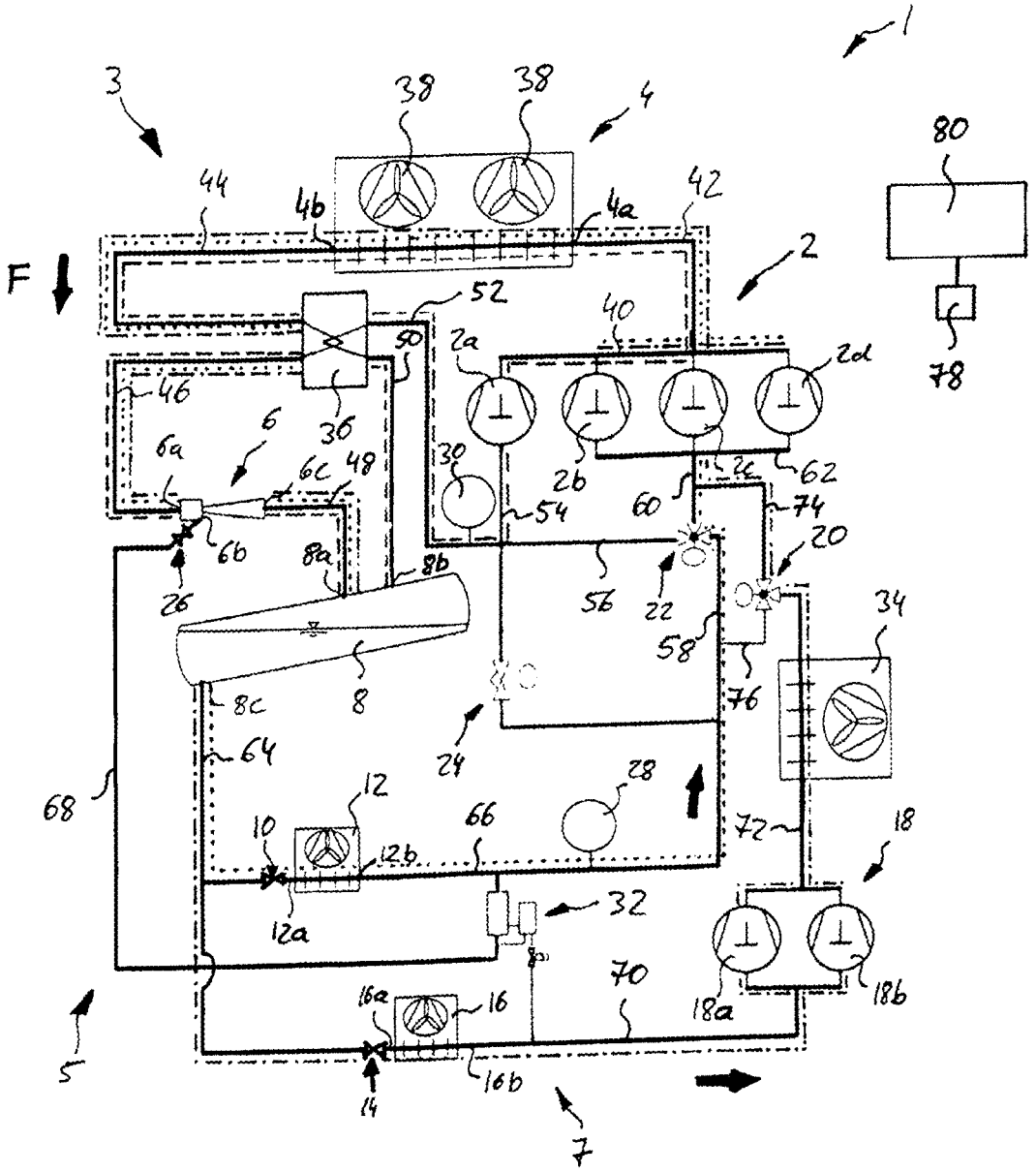
FIG. 2 shows refrigeration system according to an exemplary embodiment of the invention operating in a second mode of operation.

At higher ambient temperatures, e.g. in the range of 10-15° C. to 18-20° C., which are detected either directly by means of the ambient temperature sensor 78 or indirectly by a change of the refrigerant pressure measured by at least one of the sensors 28, 30, the control unit 80 switches the refrigeration system 1 into a second mode of operation ("economized mode"), which is illustrated in FIG. 2.

In said second mode of operation the economizer valve 24 is shut in order to deliver the gas phase refrigerant supplied by the receiver 8 to the economizer compressor 2*a* instead of delivering it to the standard compressors 2*b*, 2*c*, 2*d* as it is done in the first mode of operation.

Thus, when the system is operated in the second mode of operation ("economized mode"), the refrigerant circulating within the ejector circuit 3 is driven and compressed only by means of the economizer compressor 2*a*, whereas the refrigerant supplied by the evaporators 12, 16 is still compressed by the standard compressors 2*b*, 2*c*, 2*d*. As the economizer compressor 2*a* is optimized for this kind of operation, this work sharing enhances the efficiency of the system when operated in the medium range of ambient temperatures mentioned before.

Figure 3:
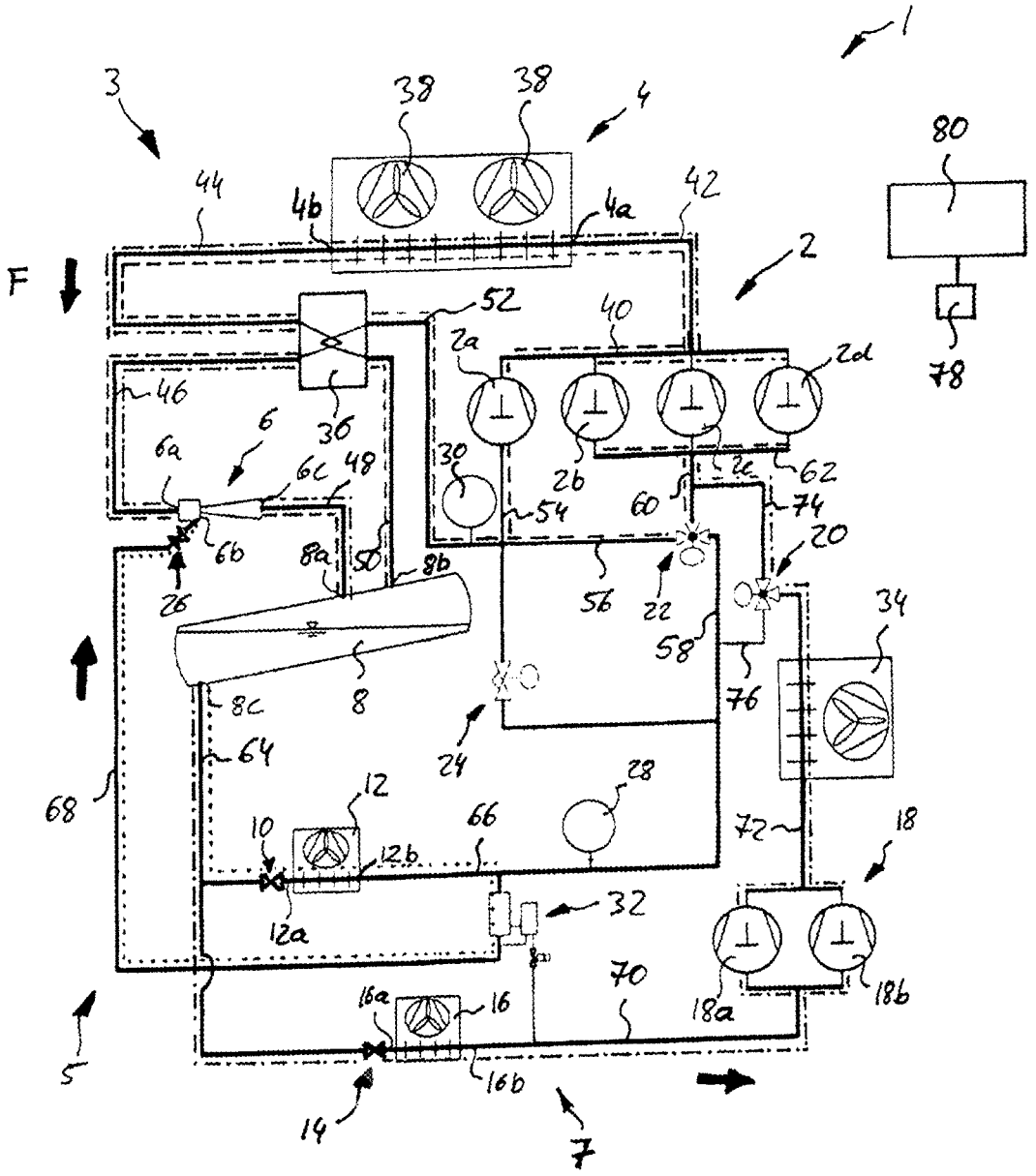
FIG. 3 shows refrigeration system according to an exemplary embodiment of the invention operating in a third mode of operation.

At even higher ambient temperatures, e.g. in the range of 18-20° C. to 30-35° C., the system is switched into a third mode of operation called "first ejector mode", which is illustrated in FIG. 3.

In said third mode of operation the economizer valve 24 remains closed as in the second mode of operation (FIG. 2), but the normal cooling temperature flowpath valve unit 22 is switched for fluidly connecting its first inlet line 56, which is fluidly connected to the evaporator's 8 gas outlet line 52, to the high pressure compressor unit inlet line 60. In consequence, the gas phase refrigerant supplied by the receiver 8 is compressed by a combination of all compressors 2*a*-2*d* of the high pressure compressor unit 2, in particular including the economizer compressor 2*a* and the standard compressors 2*b*, 2*c*, 2*d*.

Further, in said third mode the normal cooling temperature flowpath valve unit 22 is switched to close the fluid connection between its second inlet line 58 fluidly connected to the outlet 12*b* of the normal cooling temperature evaporator 12 and the high pressure compressor unit line 60, and the ejector inlet valve 26 is opened. As a result, the refrigerant from the normal cooling temperature evaporator 12 is sucked by the ejector 6 via the ejector secondary inlet line 68 and the ejector inlet valve 26 into the secondary (suction) inlet 6*b* of the ejector 6.

Thus, when the refrigeration system 1 is operated in the third mode of operation ("first ejector mode"), which is illustrated in FIG. 3, the refrigerant of the normal cooling temperature flowpath 5 is not delivered to the compressors 2*a*-2*d* of the high pressure compressor unit 2 anymore, but it is driven only by means of the ejector 6. In contrast, the refrigerant of the freezing temperature flowpath 7 is still compressed by the freezing temperature compressor unit 18 and the successive high pressure compressor unit 2, as the freezing temperature flowpath valve unit 20 has not been switched with respect to the first and second modes of operation.

Figure 4:
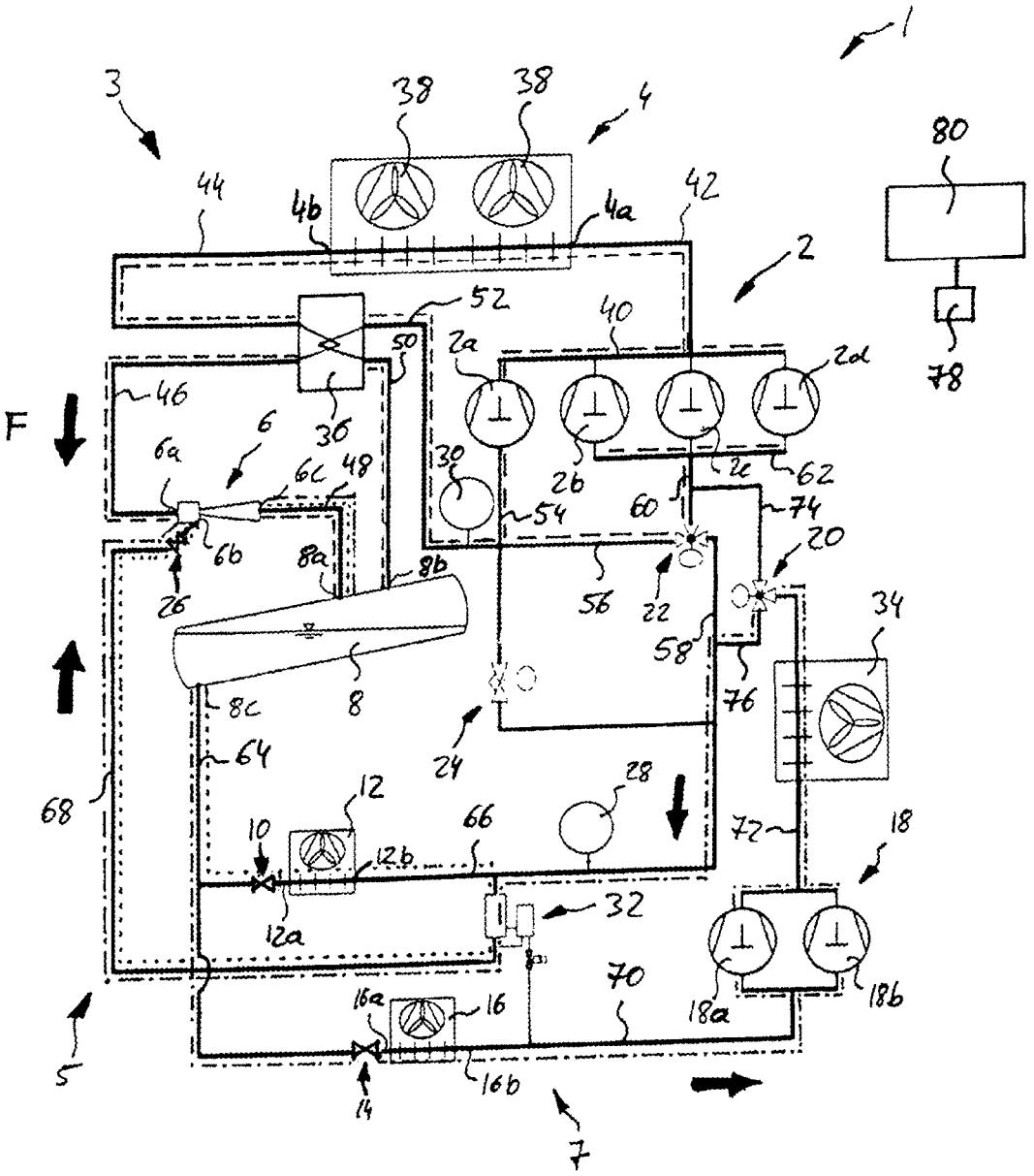
FIG. 4 shows refrigeration system according to an exemplary embodiment of the invention operating in a fourth mode of operation.

Finally, in case the ambient temperature increases even further to very high temperatures above 30-35° C., the refrigeration system 1 is switched into a fourth mode of operation, which is called "second ejector mode" and illustrated in FIG. 4.

For switching the refrigeration system from the third mode of operation ("first ejector mode"), which has been described before with reference to FIG. 3, into the fourth mode of operation ("second ejector mode") the freezing temperature flowpath valve unit 20 is switched to deliver the refrigerant supplied by the freezing temperature compressor unit 18 via its second outlet line 76 into the second inlet line 58 of the normal cooling temperature flowpath valve unit 22 instead of delivering the refrigerant into the high pressure compressor unit inlet line 60.

When the refrigeration system 2 is operated in said fourth mode of operation ("second ejector mode"), the position of the normal cooling temperature flowpath valve unit 22 remains the same as in the third mode of operation ("first ejector mode"), i.e. the connection between the second inlet line 58 of the normal cooling temperature flowpath valve unit 22 and the high pressure compressor unit inlet line 60 remains closed. In consequence, the refrigerant supplied by the freezing temperature compressor unit 18 is delivered via the second inlet line 58 of the normal cooling temperature flowpath valve unit 22 together with the refrigerant supplied by the normal cooling temperature evaporator 12 into the ejector secondary inlet line 68 from where it is sucked through the open ejector inlet valve 26 into the secondary (suction) inlet 8*b* of the ejector 6.

Thus, when the refrigeration system 2 is operated in said fourth mode of operation ("second ejector mode"), the refrigerant flow of the normal cooling temperature flowpath 5 as well as the refrigerant flow of the freezing temperature flowpath 7 are both driven only by means of the ejector 6, and the compressors 2*a*-2*d* of the high pressure compressor unit 2 are operated only for driving the refrigerant circulating within the ejector circuit 3 driving the ejector 6.

A refrigeration system, as it has been described before, may be operated with high efficiency over a wide range of ambient temperatures, in particular from ambient temperatures below 10° C. to ambient temperatures above 35° C.

Further Embodiments

In an embodiment the high pressure compressor unit comprises an economizer compressor and at least one standard compressor in order to allow an economical compression of the refrigerant by means of the economizer compressor.

In an embodiment the refrigeration system further comprises an economizer valve which is configured for fluidly connecting the gas outlet of the receiver selectively to the inlet(s) of the economizer compressor or to the inlet(s) of the at least one standard compressor. This allows to selectively compress the refrigerant by means of the economizer compressor and/or by means of the standard compressor(s) in order to select the most efficient compression, which may depend on the actual environmental conditions, in particular including the ambient temperature, and/or the pressure of the refrigerant.

In an embodiment the normal cooling temperature flowpath valve unit comprises: an outlet fluidly connected to the inlet side of the high pressure compressor unit, a first inlet fluidly connected to the gas outlet of the receiver, and a second inlet fluidly connected to an outlet of the normal cooling temperature evaporator. Such a configuration allows to select efficiently between different modes of operation by switching the normal cooling temperature flowpath valve unit.

In an embodiment the freezing temperature flowpath valve unit comprises: an inlet fluidly connected to an outlet side of the freezing temperature compressor unit, a first outlet fluidly connected to the inlet side of the high pressure compressor unit, and a second outlet fluidly connected to the ejector secondary inlet line. Such a configuration allows to select efficiently between different modes of operation by switching the freezing temperature flowpath valve unit.

In an embodiment at least one of the freezing temperature flowpath valve unit and the normal cooling temperature flowpath valve unit comprises a three-way-valve. A three-way-valve provides a compact and cheap valve unit providing the desired functionality. Alternatively, the valve unit(s) may be provided by an appropriate combination of at least two simple two-way-valves.

At least one of the valves may be an adjustable valve, in particular a continuously adjustable valve, for allowing to switch gradually, in particular continuously between the different modes of operation.

In an embodiment a desuperheater is arranged between the freezing temperature compressor unit and the freezing temperature flowpath valve unit, which allows to enhance the efficiency of the freezing temperature flowpath even further.

In an embodiment the refrigeration system further comprises a suction line heat exchanger which is configured for providing heat exchange between refrigerant flowing from the gas outlet of the receiver to the high pressure compressor unit and refrigerant flowing from the heat rejecting heat exchanger/gas cooler to the ejector in order to enhance the efficiency of the ejector circuit.

In an embodiment the refrigeration system further comprises at least one pressure and/or temperature sensor which is configured for measuring the pressure/temperature of the refrigerant circulating within the refrigeration system.

Such a sensor in particular may be provided at the inlet side of the high pressure compressor unit and/or at the outlet of the normal cooling temperature evaporator.

Providing such sensors allows to switch between the different modes of operation based on the pressure and/or temperature of the refrigerant measured by the sensors. Alternatively or additionally an ambient temperature sensor may be provided allowing to switch between different modes of operation based on the measured ambient temperature.

In an embodiment the refrigeration system further comprises an oil separator for separating oil from the refrigerant, in particular from the refrigerant flowing within the normal temperature flowpath in order to avoid that the compressors run out of oil.

In an embodiment the oil separator is in particular configured to deliver the oil, which has been separated from the refrigerant, to the inlet of the freezing temperature compressor unit in order to ensure a sufficient supply of oil to the compressors of the freezing temperature compressor unit.

While the invention has been described with reference to exemplary embodiments, it will be understood by those skilled in the art that various changes may be made and equivalence may be substitute for elements thereof without departing from the scope of the invention. In particular, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

REFERENCE NUMERALS

1 refrigeration system
2 high pressure compressor unit
2*a* economizer compressor
2*b*, 2*c*, 2*d* standard compressors
3 ejector circuit
4 heat rejecting heat exchanger/gas cooler
4*a* inlet of the heat rejecting heat exchanger/gas cooler
4*b* outlet of the heat rejecting heat exchanger/gas cooler
5 normal cooling temperature flowpath
6 ejector
6*a* primary inlet of the ejector
6*b* secondary inlet of the ejector
6*c* outlet of the ejector
7 freezing temperature flowpath
8 receiver
8*a* inlet of the receiver
8*b* gas outlet of the receiver
8*c* liquid outlet of the receiver
10 normal cooling temperature expansion device
12 normal cooling temperature evaporator
12*a* inlet of the normal cooling temperature evaporator
12*b* outlet of the normal cooling temperature evaporator
14 freezing temperature expansion device
16 freezing temperature evaporator
16*a* inlet of the freezing temperature evaporator
16*b* outlet of the normal cooling temperature evaporator
18 freezing temperature compressor unit
18*a*, 18*b* freezing temperature compressors
20 freezing temperature flowpath valve unit
22 normal cooling temperature flowpath valve unit
24 economizer valve
26 ejector inlet valve
28, 30 pressure sensors
32 oil separator
34 desuperheater
36 suction line heat exchanger
38 fan
40 manifold of the high pressure compressor unit
42 heat rejecting heat exchanger/gas cooler inlet line
44 heat rejecting heat exchanger/gas cooler outlet line
46 ejector primary inlet line
48 ejector outlet line
50, 52 receiver gas outlet line
54 economizer compressor inlet line
56 first inlet line of the normal cooling temperature flowpath valve unit
58 second inlet line of the normal cooling temperature flowpath valve unit
60 high pressure compressor unit inlet line
62 high pressure compressor unit inlet manifold
64 receiver liquid outlet line
66 normal cooling temperature evaporator outlet line
68 ejector secondary inlet line
70 freezing temperature evaporator outlet line
72 freezing temperature compressor unit outlet line
74 first outlet line of the freezing temperature flowpath valve unit
76 second outlet line of the freezing temperature flowpath valve unit
78 ambient temperature sensor
80 control unit

The invention claimed is:

1. A refrigeration system comprising
A) an ejector circuit comprising in the direction of flow of a circulating refrigerant:
Aa) a high pressure compressor unit comprising at least one compressor;
Ab) a heat rejecting heat exchanger/gas cooler;
Ac) an ejector having
a primary inlet fluidly connected to the outlet(s) of the heat rejecting heat exchanger/gas cooler;
a secondary inlet; and
an outlet, which is fluidly connected to
Ad) a receiver having a gas outlet which is connected to an inlet of the high pressure compressor unit;
B) a normal cooling temperature flowpath comprising in the direction of flow of the refrigerant:
Ba) a normal cooling temperature expansion device fluidly connected to a liquid outlet of the receiver;
Bb) a normal cooling temperature evaporator;
Bc) an ejector secondary inlet line with an ejector inlet valve fluidly connecting an outlet of the normal cooling temperature evaporator to the secondary inlet of the ejector; and
Bd) a normal cooling temperature flowpath valve unit configured for fluidly connecting the inlet of the high pressure compressor unit selectively either to the gas outlet of the receiver or to the outlet of the normal cooling temperature evaporator;
C) a freezing temperature flowpath comprising in the direction of flow of the refrigerant:
Ca) a freezing temperature expansion device fluidly connected to the liquid outlet of the receiver;
Cb) a freezing temperature evaporator;
Cc) a freezing temperature compressor unit comprising at least one freezing temperature compressor; and
Cd) a freezing temperature flowpath valve unit configured for fluidly connecting the outlet of the freezing temperature compressor unit selectively either to the inlet of the high pressure compressor unit or to the ejector inlet valve
wherein a desuperheater is arranged between the freezing temperature compressor unit and the freezing temperature flowpath valve unit.

2. The refrigeration system of claim 1, wherein the high pressure compressor unit comprises an economizer compressor and at least one standard compressor.

3. The refrigeration system of claim 2, further comprising an economizer valve, the economizer valve and the normal cooling temperature flowpath valve unit being configured for fluidly connecting the gas outlet of the receiver selectively to the inlet(s) of the economizer compressor or to the inlet(s) of the at least one standard compressor.

4. The refrigeration system of claim 1, wherein the normal cooling temperature flowpath valve unit comprises:
an outlet fluidly connected to the inlet side of the high pressure compressor unit;
a first inlet fluidly connected to the gas outlet of the receiver; and a second inlet fluidly connected to an outlet of the normal cooling temperature evaporator;

and allows to fluidly connect the outlet selectively with the first inlet or the second inlet.

5. The refrigeration system of claim 1, wherein the freezing temperature flowpath valve unit comprises:

an inlet fluidly connected to an outlet side of the freezing temperature compressor unit;

a first outlet fluidly connected to the inlet side of the high pressure compressor unit; and a second outlet fluidly connected to the ejector secondary inlet line;

and allows to fluidly connect the inlet selectively with the first outlet or the second outlet.

6. The refrigeration system of claim 1, wherein at least one of the freezing temperature flowpath valve unit and the normal cooling temperature flowpath valve unit comprises a three-way-valve or a combination of at least two valves, wherein at least one of the valves is in particular an adjustable valve.

7. The refrigeration system of claim 1, comprising a suction line heat exchanger providing heat exchange between refrigerant flowing from the gas outlet of the receiver to the high pressure compressor unit and refrigerant flowing from the heat rejecting heat exchanger/gas cooler to the ejector.

8. The refrigeration system of claim 1, further comprising at least one of an ambient temperature sensor, which is configured for measuring the ambient temperature, a pressure sensor, which is configured for measuring the pressure of the refrigerant at the inlet side of the high pressure compressor unit, and a pressure sensor, which is configured for measuring the pressure of the refrigerant at the outlet of the normal cooling temperature evaporator.

9. The refrigeration system of claim 1, further comprising an oil separator for separating oil from the refrigerant, in particular from refrigerant flowing within the normal temperature flowpath.

10. The refrigeration system of claim 9, wherein the oil separator is configured to deliver the oil, which has been separated from the refrigerant leaving the normal cooling temperature evaporator to the inlet of the freezing temperature compressor unit.

11. A method of operating a refrigeration system of claim 1 in a standard mode, the method comprising:

circulating a first flow of refrigerant from the high pressure compressor unit via the heat rejecting heat exchanger/gas cooler;

the ejector and the receiver to the inlet side of the high pressure compressor unit;

directing a second flow of refrigerant from the receiver via the normal cooling temperature expansion device and the normal cooling temperature evaporator to the inlet side of the high pressure compressor unit; and directing a third flow of refrigerant from the receiver via the freezing temperature expansion device, the freezing temperature evaporator and the freezing temperature compressor unit to the inlet side of the high pressure compressor unit.

12. A method of operating a refrigeration system of claim 7 in a first ejector mode, the method comprising:

circulating a first flow of refrigerant from the high pressure compressor unit via the heat rejecting heat exchanger/gas cooler; the ejector and the receiver back to the inlet side of the high pressure compressor unit;

directing a second flow of refrigerant from the receiver via the normal cooling temperature expansion device, the normal cooling temperature evaporator and the ejector inlet valve to the secondary inlet of the ejector; and directing a third flow of refrigerant from the receiver via the freezing temperature expansion device, the freezing temperature evaporator and the freezing temperature compressor unit to the inlet side of the high pressure compressor unit.

13. A method of operating a refrigeration system of claim 1 in a second ejector mode, the method comprising:

circulating a first flow of refrigerant from the high pressure compressor unit via the heat rejecting heat exchanger/gas cooler; the ejector and the receiver to the inlet side of the high pressure compressor unit;

directing a second flow of refrigerant from the receiver via the normal cooling temperature expansion device, the normal cooling temperature evaporator and the ejector inlet valve to the secondary inlet of the ejector; and directing a third flow of refrigerant from the receiver via the freezing temperature expansion device, the freezing temperature evaporator, the freezing temperature compressor unit and the ejector inlet valve to the secondary inlet of the ejector.

14. A method of operating a refrigeration system according to claim 1 in an economizer mode, wherein the method comprises directing refrigerant from the gas outlet of the receiver to the economizer compressor of the high pressure compressor unit.

* * * * *